US012558608B1

(12) United States Patent
Doron et al.

(10) Patent No.: US 12,558,608 B1
(45) Date of Patent: Feb. 24, 2026

(54) GAME AND GAME STORAGE BOX

(71) Applicant: E-Z D Enterprises, LLC, Metairie, LA (US)

(72) Inventors: Eli Zev Doron, Katonah, NY (US); Herbert Irving Miller, Metairie, LA (US); Gia Elisa Miller, Katonah, NY (US)

(73) Assignee: E-Z D Enterprises, LLC, Metairie, LA (US)

( * ) Notice: Subject to any disclaimer, the term of this patent is extended or adjusted under 35 U.S.C. 154(b) by 966 days.

(21) Appl. No.: 17/716,799

(22) Filed: Apr. 8, 2022

Related U.S. Application Data

(60) Provisional application No. 63/260,657, filed on Aug. 27, 2021, provisional application No. 63/172,419, filed on Apr. 8, 2021.

(51) Int. Cl.
*A63F 3/00* (2006.01)

(52) U.S. Cl.
CPC ..... *A63F 3/00094* (2013.01); *A63F 3/00697* (2013.01); *A63F 2003/00839* (2013.01)

(58) Field of Classification Search
CPC ..... A63F 3/00094; A63F 2003/00839; A63F 2003/00943; A63F 2003/00946; A63F 2003/00949; A63F 2003/00955; A63F 2003/00962; A63F 2003/00965
USPC ..... 273/271
See application file for complete search history.

(56) References Cited

U.S. PATENT DOCUMENTS 3,506,267 A * 4/1970 Taillie ..... A63F 3/00 273/272
3,599,977 A 8/1971 Glass et al.
3,747,926 A 7/1973 Odom
3,770,273 A * 11/1973 Reiner ..... A63F 9/02 273/272
4,234,185 A * 11/1980 Alsip ..... A63F 7/0076 273/284

(Continued)

FOREIGN PATENT DOCUMENTS

GB 2360950 10/2001

OTHER PUBLICATIONS

Tic Tac Toe War Touch to Play Family Fun Yard Game (marketplace.secondlift.com/p/Tic-Tac-Toe-Touch-to-Play-Family-Fun-Yard-Game/12832741).

(Continued)

*Primary Examiner* — Joseph B Baldori

(74) *Attorney, Agent, or Firm* — Garvey, Smith & Nehrbass, Patent Attorneys, L.L.C.; Fabian M. Nehrbass; Jacqueline M. Daspit

(57) ABSTRACT

A novel Tic-Tac-Toe board or electronic game differs from other versions of Tic-Tac-Toe by allowing the use of multiple "Neutrals". "Neutrals" can replace an opponent's "X" or "O" on the Tic-Tac-Toe board, possibly preventing an opponent from winning the game on his/her next move or to change the board from a losing situation into one where a player can win on his/her next move. Also, the ability to replace an opponent's "X" or "O" with a "Neutral" extends the game to an infinite number of moves rather than the nine-move limit in a typical Tic-Tac-Toe game. Other embodiments of the present invention include dice, electronics, and magnetic games. Methods of playing the game are also disclosed, as is a novel storage box.

9 Claims, 11 Drawing Sheets

(56) References Cited

U.S. PATENT DOCUMENTS 4,286,952 A * 9/1981 Roche ..... G09B 1/10 273/156
4,671,514 A * 6/1987 Wilson-Diehl ..... A63F 3/00533 273/287
4,736,955 A * 4/1988 Pollock ..... A63B 67/06 273/DIG. 30
5,248,149 A 9/1993 Tarrats
5,318,307 A * 6/1994 Bouchard ..... A63B 67/06 273/350
5,433,448 A * 7/1995 Raphael ..... A63F 3/00094 273/DIG. 30
5,507,494 A 4/1996 DeBono
5,573,247 A * 11/1996 Ridge ..... A63B 63/08 273/271
5,580,059 A * 12/1996 Marks ..... G07F 17/3276 273/271
6,254,098 B1 * 7/2001 Kirkpatrick ..... A63F 3/00643 273/271
6,293,550 B1 * 9/2001 Zeitlin ..... A63F 3/00694 273/271
8,210,537 B1 7/2012 Ladhe et al.
8,235,207 B2 * 8/2012 Dietenberger ..... A63F 9/1044 273/148 R
8,505,918 B1 * 8/2013 Appelblatt ..... A63F 3/00694 273/271
8,651,488 B2 * 2/2014 Mulholland ..... A63F 3/00214 273/153 R
8,876,112 B2 * 11/2014 Skinner ..... A63F 3/00574 273/239
D745,930 S * 12/2015 Tirupati ..... D21/373
D745,931 S * 12/2015 Tirupati ..... D21/373
D746,381 S * 12/2015 Tirupati ..... D21/373
9,694,273 B2 * 7/2017 Goldblatt ..... A63F 3/00173
10,099,112 B1 10/2018 Johnson
10,300,367 B1 * 5/2019 Douglas, Jr. ..... A63F 3/00261
10,391,385 B2 * 8/2019 McAuley ..... A63F 3/00261
10,993,586 B2 * 5/2021 Meise ..... A63F 3/00094
11,241,612 B1 * 2/2022 Porter ..... A63F 11/0074
11,260,282 B2 * 3/2022 Martinez ..... A63F 3/00694
11,986,741 B1 * 5/2024 Young ..... A63F 3/00895
12,151,175 B2 * 11/2024 Vuu ..... A63F 3/00697
2007/0035087 A1 * 2/2007 Guagliardo ..... A63F 3/00 273/243
2010/0244379 A1 * 9/2010 McKinzie ..... A63F 3/00094 273/271
2011/0095479 A1 * 4/2011 Attwood ..... A63F 3/00094 273/271
2015/0251083 A1 * 9/2015 Wright ..... A63F 3/0457 273/242
2015/0265911 A1 9/2015 Taft
2016/0045820 A1 * 2/2016 Rasmussen ..... A63F 3/00094 463/9

OTHER PUBLICATIONS

Switch-Tac-Toe (https://www.metacritic.com/game/ios/switch-tac-toe).

* cited by examiner

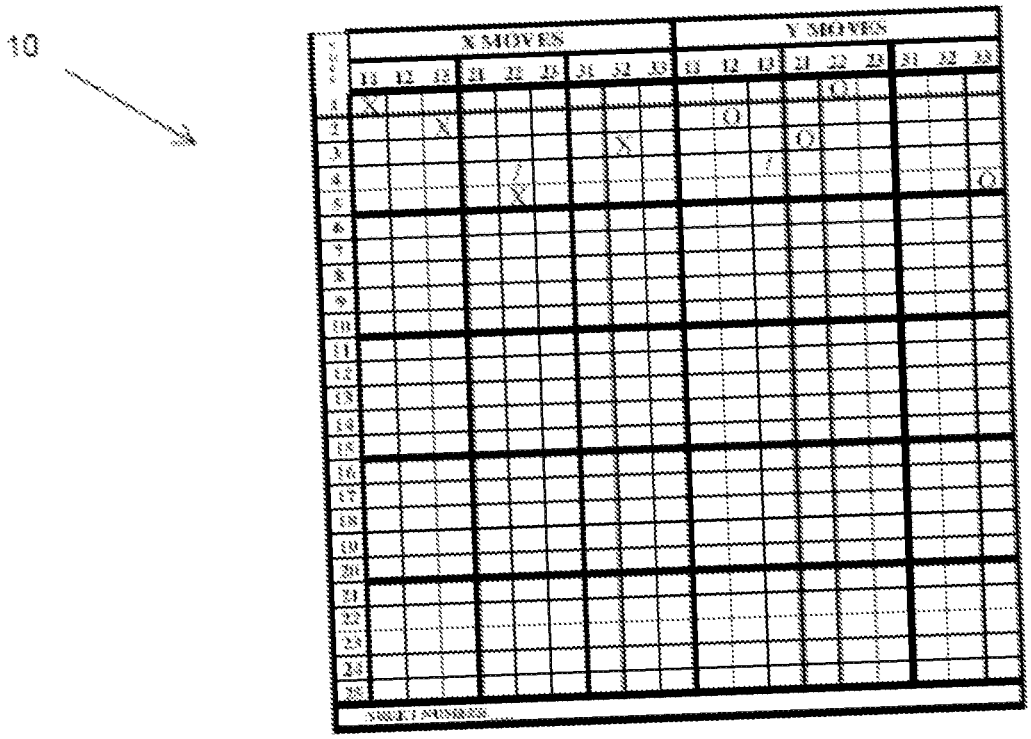
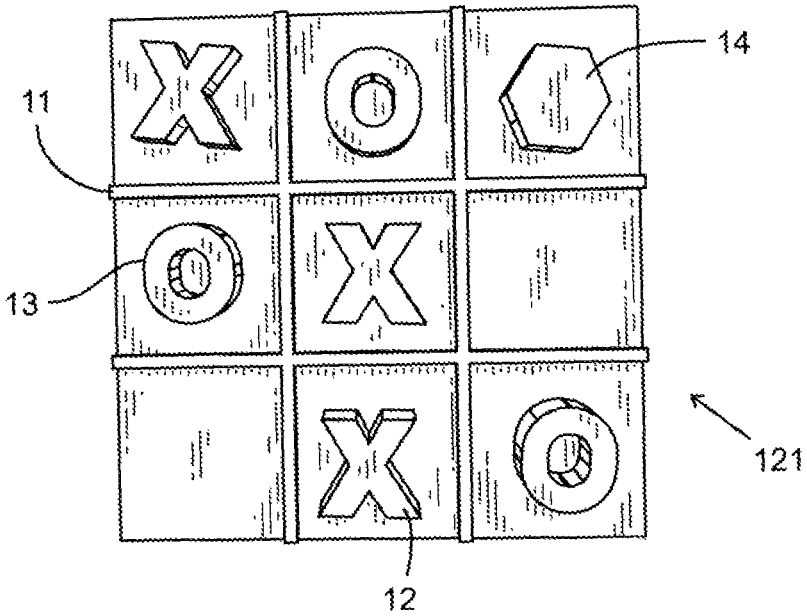
FIG. 2

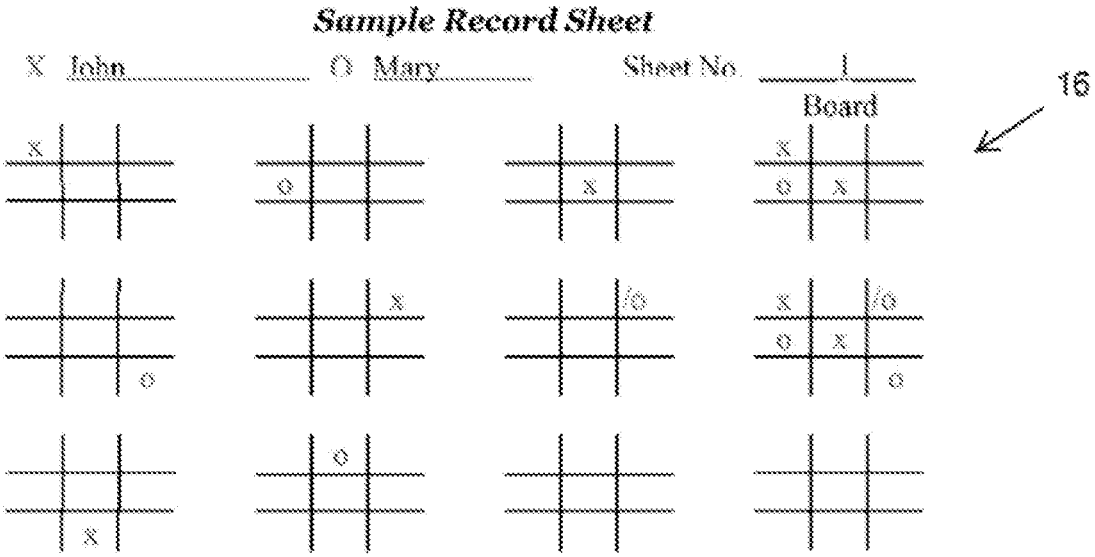
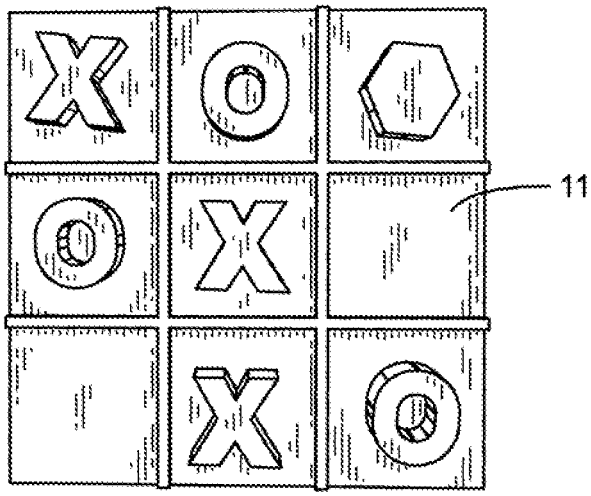
FIG. 4

Tic-Tac-XNO Score Sheet

| Date | X Player | O Player | Version Played | Winner |
|---|---|---|---|---|
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |

FIG. 5

X occupies the center square. O then occupies the top, right corner.

X switches the O to an N, X-side up.

O occupies the bottom left, blocking a potential win from X.

X occupies top middle.

O removes middle X and replaces it with an N.

X occupies bottom right.

O removes bottom right X and replaces it with an N.

X occupies top left.

O occupies bottom middle, setting up for two potential ways to win.

X occupies top middle, , setting up for two potential ways to win.

O switches it's bottom right N to an O.

O wins! Congratulations, O!

FIG. 8

GAME AND GAME STORAGE BOX

CROSS-REFERENCE TO RELATED APPLICATIONS

Priority of our U.S. Provisional Patent Application Ser. Nos. 63/172,419, filed 8 Apr. 2021, and 63/260,657, filed 27 Aug. 2021, each which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to tic tac toe games and game storage boxes. More particularly, the present invention relates to a new game based on the game of tic tac toe and an improved storage box.

2. General Background of the Invention

Tic tac toe has been around for a very long time, and there are many variations on this old game.

The following Patent Documents are incorporated herein by reference:

- U.S. Pat. No. 3,599,977 ("Rotary Block Tic-Tac-Toe Board and Projectiles"); U.S. Pat. No. 3,747,926 ("Tic Tac Toe Game); U.S. Pat. No. 5,248,149 ("Method of playing tic-tac-toe with cards"); U.S. Pat. No. 5,507,494 ("Three Spot Game"); U.S. Pat. No. 8,210,537 ("Multi-Grid Tic-Tac-Toe Game"); and U.S. Pat. No. 10,099,112 ("Three-Dimensional Tic-Tac-Toe");
- U.S. Patent App. Pub. No. 2015/0265911 ("Electronic Tic Tac Toe Game With Extended Play And A Winner In Every Game"); and
- UK Patent Application GB 2 360 950 ("Noughts and crosses game").
- U.S. Pat. No. 5,507,494 ("Three Spot Game") discloses a game which is played with a set of 3×3 squares and the use of "neutral" pieces, though the other pieces used are not akin to traditional "x's" and "o's" and the game is not a variant of "tic-tac-toe."

U.S. Pat. No. 5,248,149 ("Method of playing tic-tac-toe with cards") discloses a method of playing a variation of tic-tac-toe with cards, including the use of neutral cards, as stated: "A further variation is to include blank cards in the deck. A player who draws a blank card may place it on top of any opposing player's card (or remove the opposing player's card) to thereby render the playing space neutral or open, even though it previously was controlled by an opposing player's card. Thus, a player drawing a blank can re-open a playing space. If the first player draws a blank on his initial turn, he can either be allowed to reselect a card from the deck or he loses his turn."

U.S. Publication No. 2015/0265911 ("Electronic Tic Tac Toe Game With Extended Play And A Winner In Every Game") discloses a variation of tic-tac-toe wherein the game is played electronically and "the game will continue until a winner is achieved for every game, the grid will be evaluated when any player has placed their fourth marker on the grid, and at every successive play after that—and if a winner has not yet been achieved, then one of that player's markers will be removed from the grid, to allow play to continue until one player has achieved three in a row, allowing a winner to be declared."

Board games in general and likewise storage boxes for board games have existed for years. Most storage boxes are designed to hold the board and pieces required for game play for their respective games. For games where the box length and width are desired to be no larger than required, removal of the board is often more difficult than necessary.

BRIEF SUMMARY OF THE INVENTION

The present invention is a novel Tic-Tac-Toe board or electronic game. For the board game version, there is also a novel game storage box which provides easier access for game play, as well as improved travel play.

1. The Game

The game of the present invention differs from other versions of Tic-Tac-Toe by allowing the use of multiple "Neutrals". "Neutral" pieces may later be changed to an "X" or and "O" based on the rules of the game. "Neutrals" can replace an opponent's "X" or "O" on the Tic-Tac-Toe board, possibly preventing an opponent from winning the game on his/her next move or to change the board from a losing situation into one where a player can win on his/her next move. Also, the ability to replace an opponent's "X" or "O" with a "Neutral" extends the game to an infinite number of moves rather than the nine-move limit in a typical Tic-Tac-Toe game. It is possible that the entire board could be covered in "Neutrals" which would essentially reset the game to the starting position. The game preferably comes with multiple versions of play involving different limitations on "Neutrals". In one embodiment, dice are preferably used to determine if a player must play his "X" or "O" or must replace one of his opponent's pieces with a "Neutral". A "family" version of the game may also be marketed, including, for example, two sets of the game pieces so that a family of four can play two games simultaneously.

2. The Game Storage Box

The present invention includes a storage box for board games which includes a feature to allow easier removal of the game board compared to prior art boxes.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 2 is a top view of a game board of a preferred embodiment of the present invention along with a corresponding record sheet showing the moves which would result in a board with pieces as shown;

FIG. 4 shows a sample record sheet and corresponding game board of a preferred embodiment of the present invention;

FIG. 5 is a game score sheet of a preferred embodiment of the present invention;

FIG. 8 shows a record sheet of an example of a game played of a preferred embodiment of the present invention;

DETAILED DESCRIPTION OF THE INVENTION

Figure 1:
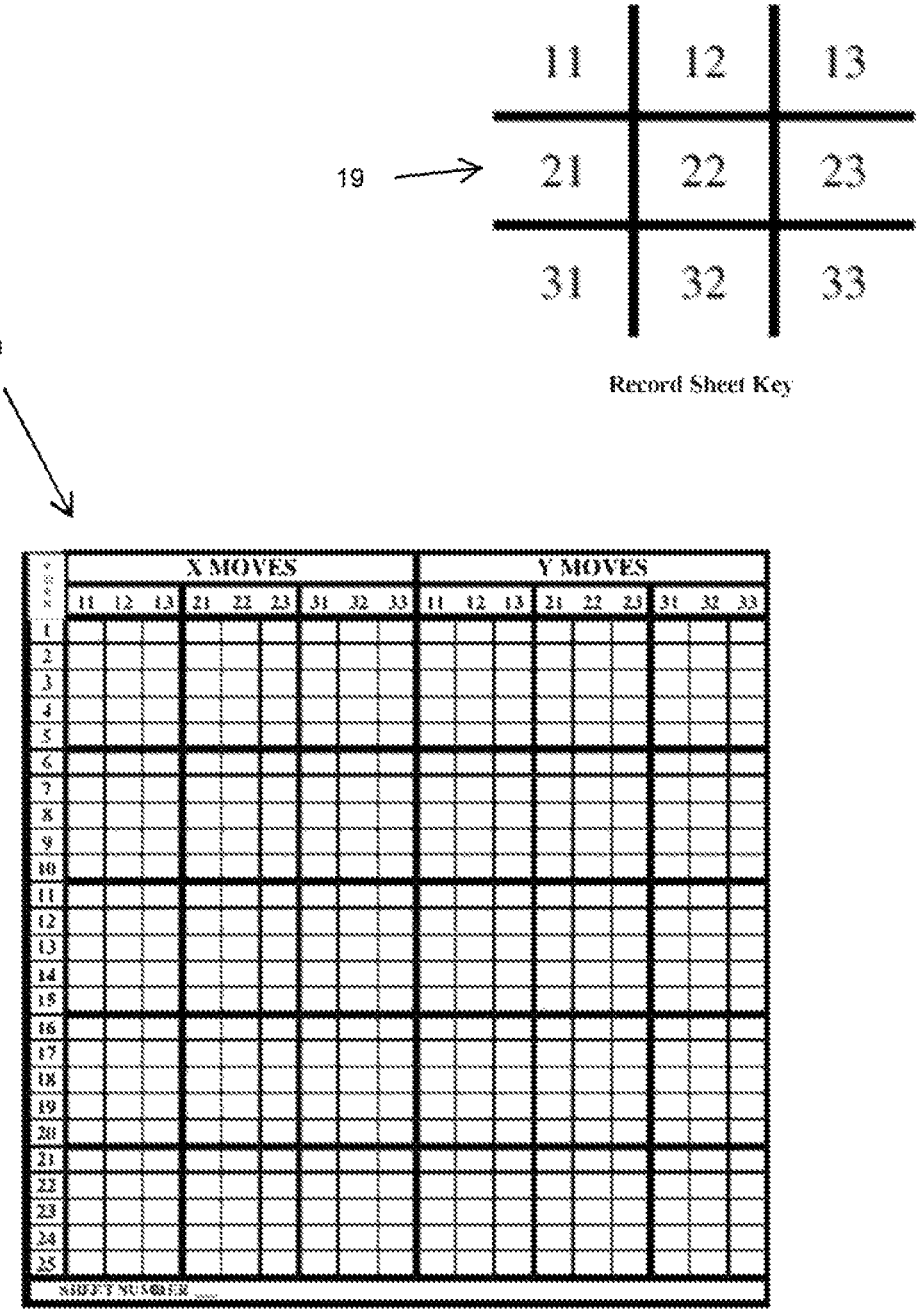
FIG. 1 is a sample record sheet of a preferred embodiment of the present invention along with a record sheet key identifying which numbers correspond to which spaces.

In various versions of the game of the present invention, record sheets (see FIGS. 1-2 and 4) may be utilized to track the moves of the players. One or both players can record the moves of the game as it is played. The ability to record allows the players to return to the game later to study the game played. FIG. 1 depicts a sample record sheet of a preferred embodiment of the present invention, designated generally by the numeral 10. As seen in FIG. 1, a record sheet 10 of the present invention may comprise nine columns for X moves (columns 11, 12, 13, 21, 22, 23, 31, 32, and 33 below "X MOVES") and nine columns for Y moves (columns 11, 12, 13, 21, 22, 23, 31, 32, and 33 below "Y MOVES").

Each record sheet can have a row for each turn. For example, the record sheet of FIG. 1 has 25 rows for the turns, wherein each turn consists of a move by the player using the X pieces and a move by the player using the Y pieces. The record sheet key 19 of FIG. 1 contains numbers 11, 12, 13, 21, 22, 23, 31, 32, and 33 in the nine square places of a traditional tic tac toe game. Each number corresponds to a specific square on the board. For example, number 11 corresponds to the top left most square. If the player utilizing the X pieces places an X in the middle of the board (what is designated as number 22 in the record sheet key) on their first turn, as the first move of the game, they can then record the move by placing an X in the first row of record sheet 10, under column 22.

FIG. 2 depicts a sample game board 121 of a preferred embodiment of the present invention after five turns have been played as recorded in the sample record sheet 10. As the sample record sheet 10 shows, the first move was X in space 11, the upper left corner, the second move of the first turn was O in square 22, the middle row, middle square; in the second turn, X placed in square 13, the top right most corner, followed by O in square 12, the first row, left most square; in the third turn, X placed in square 32, or the lower most row, center square, and O played in square 21, or the middle row, left most square; in the fourth turn, x played a neutral piece in square 22 (designated by "/"), the middle row, middle square; previously, O had been played here; O then followed by playing a neutral piece in square 13, or the upper row, right square (where there previously was an X); finally, in the fifth turn, X played an X in square 22, the middle row, middle square which previously had a neutral and O played an O in square 33, or the bottom row, right most square. At the end of the five turns, the board 121 looked as shown in FIG. 2. Neither side had won at this point. As seen in FIG. 2, in various embodiments, game play may comprise "X" pieces 12, "O" pieces 13, neutral pieces 14, and a game board 11 to play on. Although the neutral pieces 14 are shown with an "X" or "O" on them, in various embodiments, such as that seen in FIG. 6, the neutral pieces can vary in appearance, for example, in the fact that they include an "X" or "O" written on/imprinted on them so as to show during game play which side played the neutral piece.

Figure 3:
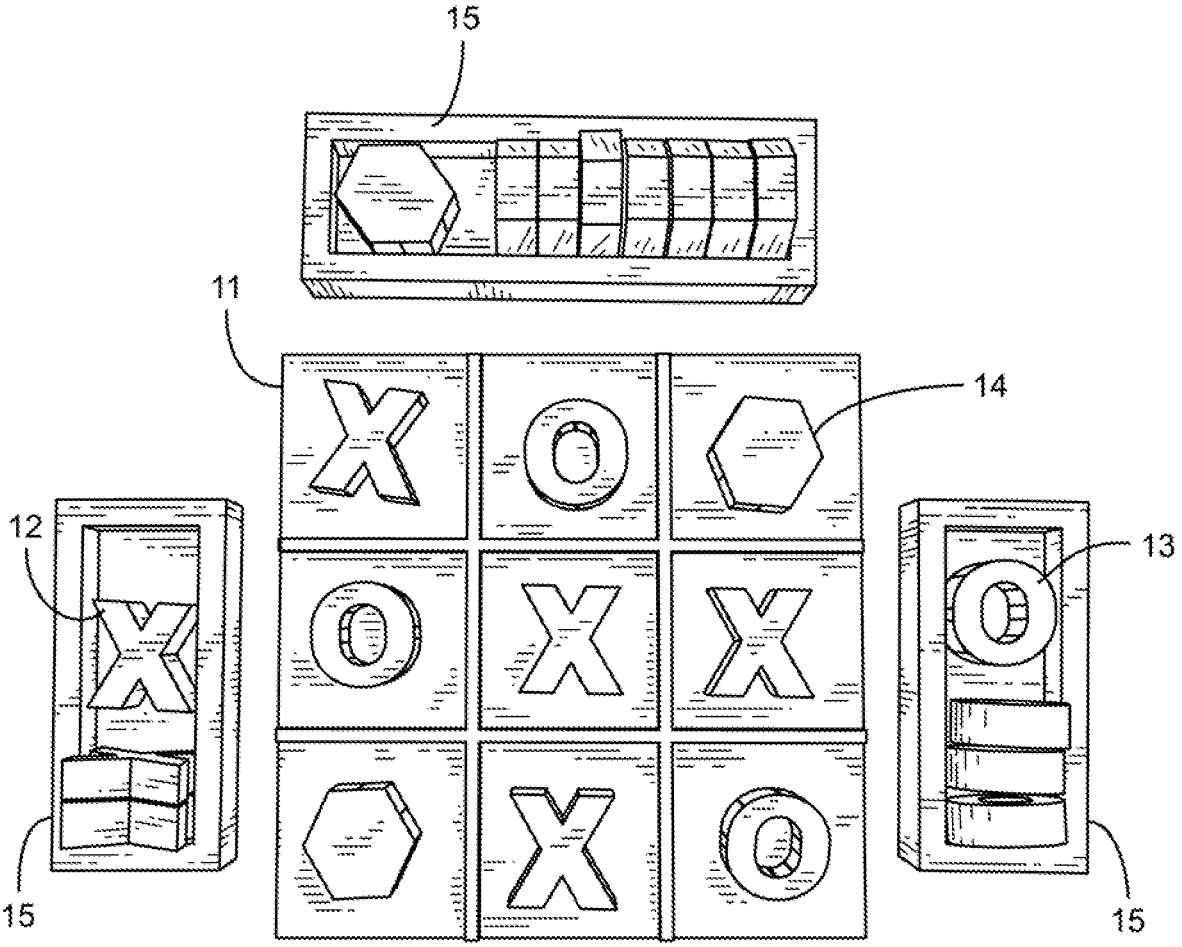
FIG. 3 is a top view of a game board of a preferred embodiment of the present invention during game play.
Figure 6:
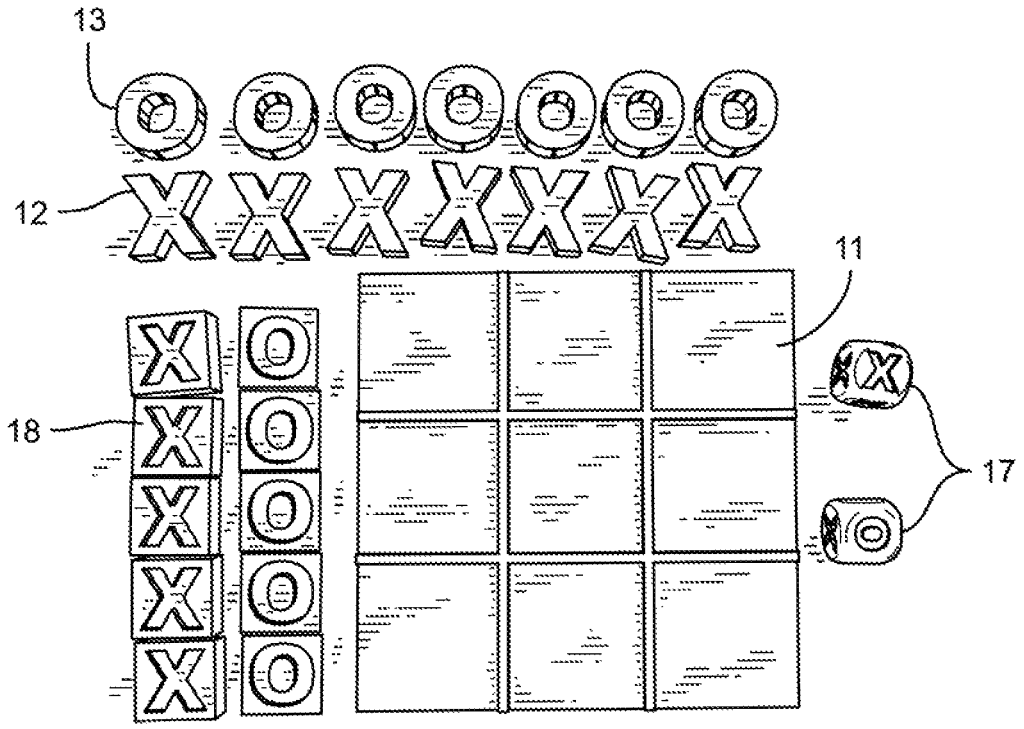
FIG. 6 shows a game board and game pieces of a preferred embodiment of the present invention.

FIGS. 3 and 6 show the game board and pieces of two preferred embodiments of the present invention. The board 11 and pieces 12, 13, 14, 18 are preferably made of plastic; however other suitable materials may be used, such as wood, metal, bamboo, or fiberglass. In some embodiments, the pieces are made of metal and magnets are used to hold the pieces in place. In such an embodiment, the board may be a magnet with metal pieces, or the board may be metal with magnetic pieces. Preferably, there is one board 11, seven "X" game pieces 12, seven "O" game pieces 13, and ten neutral pieces 14 or 18. In a preferred embodiment, the neutral pieces 18 have an "X" on one side, and an "O" on the other side, allowing them to be used as either an "X" or an "O" neutral piece as shown in FIG. 6.

Figure 7:
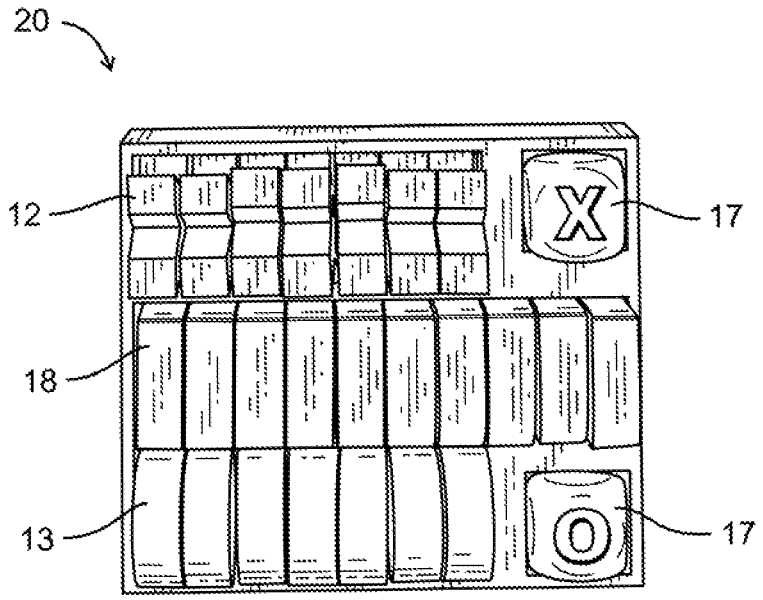
FIG. 7 shows the game pieces of a preferred embodiment of the present invention in a storage container.

In some embodiments, dice 17 shown in FIGS. 6-7, may be used in game play according to alternate rules. Preferably, the dice are 6-sided, though other sided dice can be utilized in various embodiments. In one or more embodiments, there are preferably two dice, one having an "N" on three sides and an "O" on three sides; and one having an "N" on 3 sides and an "X" on three sides; wherein the "N" signifies a neutral turn. The precise proportion of X, O, or N on the faces of the dice can vary and is not limited to having an O or X on three sides and an N or neutral on the remaining three sides.

As seen in FIG. 3, the game preferably includes one or more game piece holders 15 for easy storage of game pieces.

Figure 10:
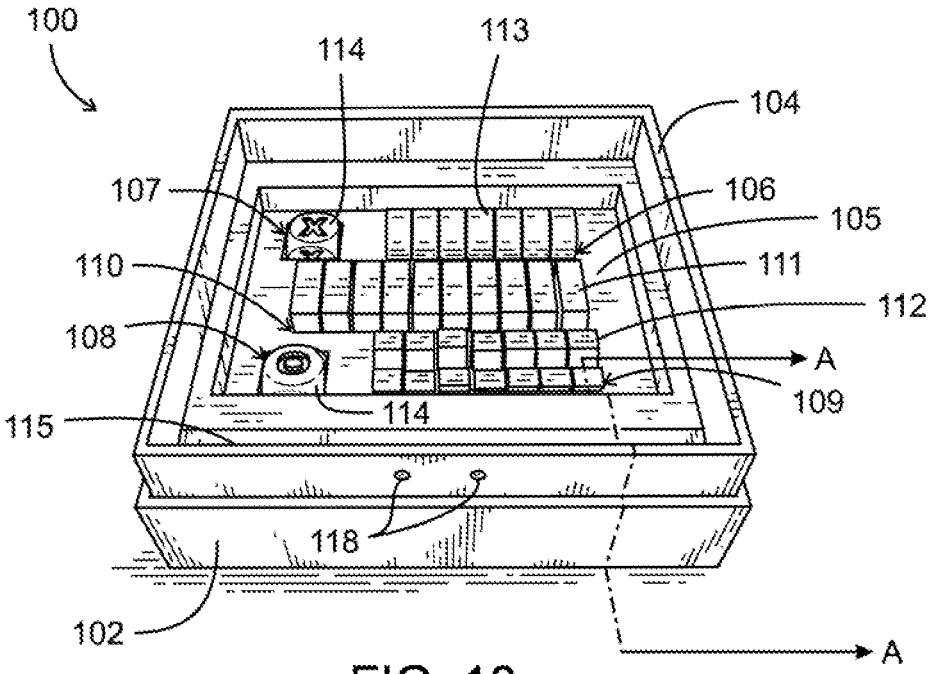
FIG. 10 is a side perspective view of a preferred embodiment of a storage box of the present invention with the top, game board holder, game board, and directions removed, showing the game pieces.

The game board and pieces may be of any size or dimension as is known in the art. For example, the game board and pieces can be of the approximate sizes disclosed in ATTACHMENT 4 filed with my U.S. Provisional Patent App. No. 63/172,419, incorporated herein by reference. Other suitable sizes can be made, such as a game board ranging from 5.5 to 11.0 inches per side. The pieces may range in size, for example, from 1.0-2.0 inches long, 1.0-2.0 inches wide, and 0.375-0.75 inches (preferably approximately 0.375 inches) thick. The dice may range in size, for example, from 0.75 to 1.5 inches per side. The storage container 20 may range in size, for example, from 4.125-4.875 inches in length, 3.6-6.6 inches in width, and 0.625-1.25 inches thick. The storage container preferably has a separate compartment to house each type of piece. For example, as seen in FIGS. 7 and 10, a storage box 20, 100 may have five compartments to house the five types of game pieces.

A web-based version of the game may be used allowing players to play against a computer or each other. Likewise, an electronic, non-web-based version may as well.

The present invention also includes methods of game play.

In a first embodiment of the game, the game begins by selecting which player will play with the X pieces and which player will play with the O pieces. This determination can be made in a number of ways, such as by agreement or a selection based on chance, such as rock paper scissors, flipping a coin, etc. For example, selection of which player will play with which pieces can be made as follows: with one player taking one X piece in one hand and one O piece in the other hand and placing both hands behind his back where he can change which hand holds which piece or keep them in the same hands. He then brings his closed hands forward and the second player chooses a hand. Whichever letter, X or O, is in the selected hand, the second player will play that letter. The player who is playing X always begins the game by making the first move by placing a X on the board. Then the player playing O places an O on the board in any unoccupied square. Play proceeds with each player alternating turns placing a piece on the board. At any time during the game after X and O have each made their first moves, either player may choose to play one of his pieces (X or O) or change one of his opponent's pieces on the board to "Neutral" by removing his opponent's piece and placing a "Neutral" piece on the board, or change a "Neutral" piece to his letter, subject to the following restriction: if a "Neutral" piece is placed on the board, the player whose piece was removed cannot change it back to his letter on his next move. However, the player that played the "Neutral" may change that "Neutral" to his letter on his next move. An example of this restriction is as follows: an "X" occupies the center square. On his turn, "O" removes the "X" in the center square and replaces it with a "Neutral". On X's next move, X cannot change the center square "Neutral" back to an "X" but can make any other move (placing an "X" on an unoccupied square or replacing a square containing an "O" with a "Neutral" or replacing a different "Neutral" with an "X"). However, on O's next move, O may choose to change the center square "Neutral" to an "O", put and "O" on an unoccupied square, change a square with an "X" on it to a "Neutral", or change a "Neutral" to "O" (except for a square than "X" changed to a "Neutral" on his last move). If "O" does not change the center square "Neutral" on his next move, the center square "Neutral" can be changed back to an "X" or "O" on any subsequent move by either player. The game continues with players alternating moves by playing either their piece on an empty square, changing one of their opponent's pieces to "Neutral", or changing an eligible "Neutral" (see prior explanation) to their letter. The game is won when one player gets three of his pieces in a single row, single column, or one of the diagonals. The next game may start with the player who last played "O" switching to play "X" to start the game.

Variations of the first embodiment can be played. In one variation, each player is limited to five changes of an opponent's piece to "Neutral". At the start of the game, each player is given five "Neutrals" to use. When a "Neutral" is removed from the board, it is placed back in the storage container and can no longer be used in the game. In another variation (or in combination with the noted variation), a player may not replace his opponent's piece with a "Neutral" on two consecutive moves if there are empty spaces on the board or there is a "Neutral" piece he eligible to change to his piece.

A second embodiment of the game is played as follows. The X's and O's are split, with each person receiving all of one letter. If both players desire the same letter, the younger player can choose first, for example. In order to select which player goes first, the players can agree on an order, or they can choose by some method of chance, such as flipping a coin. The neutral pieces are divided evenly between the two players. Each player then plays their first piece, with the first player playing first and the second player following. For all additional moves, instead of placing an X or an O on the board, a player can remove their opponent's piece and replace it with a neutral piece 18 that shows their letter face-up. When a neutral 18 is on the board 11, the only player who can remove it is the one who placed it. When a neutral is removed, it is exchanged for a letter. The game continues with players alternating moves by playing either their X 12 or O 13 on an empty square, changing an opponent's piece to a neutral, or changing their neutral to their letter. The game is won when one player gets three of their letters (no neutral pieces) in a single row, single column, or one of the diagonals, much like regular tic-tac-toe. To start the next game, the player who went second gets to go first. An example game played with the rules of the second embodiment is attached as FIG. 8.

In an intermediate variation of the second embodiment, game play is as noted except that after a neutral piece is played, the neutral is off-limits to the opposite player for their next turn only. After that, the opposite player is free to remove the neutral and replace it with their letter.

In an advanced version of the second embodiment, play is as in the intermediate variation noted above except that a neutral can be played at any time. A neutral can be played in an empty square or by removing an opponent's letter.

In another variation of the second embodiment, referred to sometimes as TIC-TAC-XNO Pro, play is as noted in any of the versions above except that the first neutral cannot be played until it can be used to block the other player from winning on their next turn.

Game play can also be varied by limiting the number of neutral pieces each player can use.

In "Limited Beginner" variations, a player can only use neutrals five times. For example, play is as mentioned, but each player is limited to five neutral pieces. As each neutral is used, the neutral is placed back in the storage container. When all five neutral pieces are used, the player can only play their letters.

In another version, a player cannot play a neutral two turns in a row. Similarly, a player cannot replace their opponent's piece with a neutral on two turns in a row.

In another version, a player cannot replace their opponent's piece with a neutral on two turns in a row if there are empty spaces on the board.

Game play can also be modified by the inclusion of dice.

In a preferred embodiment played with dice, each player plays their first move. On all following moves, each player rolls the die that responds to their letter. If you land on your letter, you must play a letter. If you land on an N, you must play a neutral piece.

In another preferred embodiment, the "Dice Switch" method, each player has the die with their opponent's letter. Each player plays their first move. On all following moves, use the dice. On your opponent's turn, you roll their die. They must play whatever you have rolled. On your turn, they roll your die. You must play whatever they rolled. (So, if X rolls an O, O plays their O. But if X rolls an N, O plays their N (neutral piece).) In another preferred embodiment, the "Dice Limited" method, players follow the rules for regular dice, but each player is limited to 5 neutral pieces. Once a player has used up all of their neutral pieces, they no longer need to roll their die. They can only play their letters. In another preferred embodiment, the "Dice Limited Switch" method, players follow the rules for dice switch, but each player is limited to 5 neutral pieces. Once a player has used up all of their neutral pieces, their die no longer needs to be rolled. They can only play their letters.

FIGS. 9-13 show a preferred embodiment of the game and storage box of the present invention. The dimensions included in this application regarding the storage box are for example only and based on the sizes of the game parts as described herein. The dimensions of all parts of the game can be scaled downward or upward, depending on the size of the game parts desired.

Figure 9:
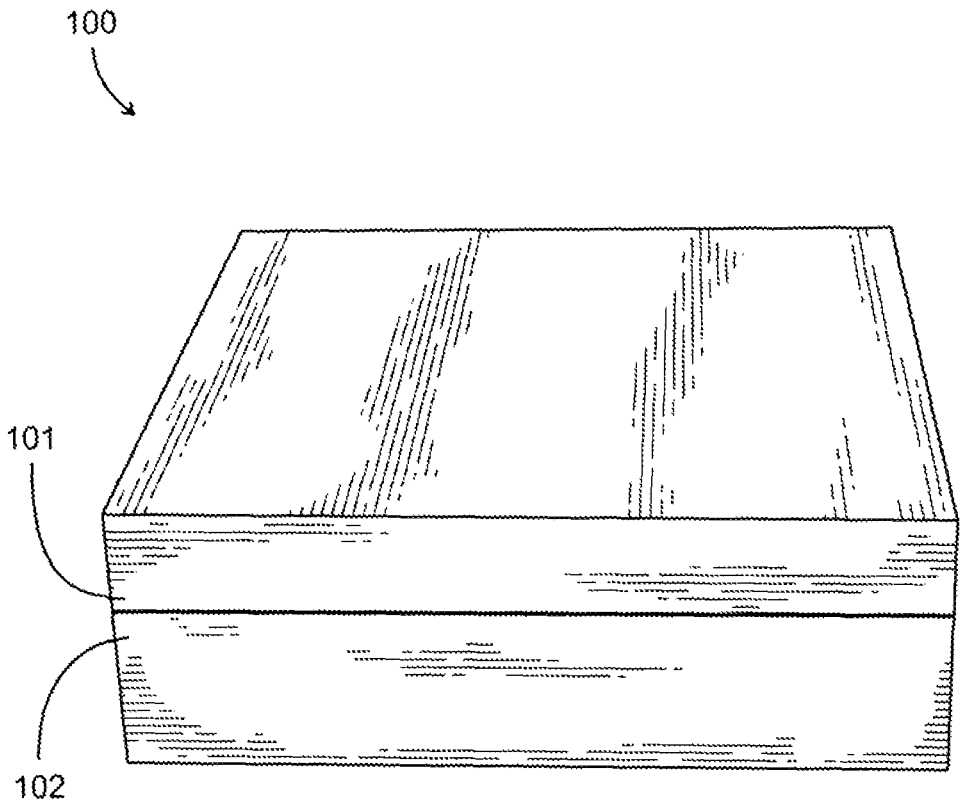
FIG. 9 is a perspective view of a preferred embodiment of a storage box of the present invention.

FIG. 9 is a perspective view of a closed storage box of a preferred embodiment of the apparatus of the present invention. Storage box 100 comprises a top 101 and bottom 102. Storage box 100 holds all parts of the game in a single container. The dimensions of storage box 100 can be 6.25" wide×6.25" long×2.16" high, including the box top, for example. The box itself consist of two parts, a top 101 and bottom 102. Any other suitable dimensions may be used.

The box top 101 preferably fits over the bottom 102. It can measure 6.25" wide×6.25" long×0.85" high. The flat box top 101 can be ⅛" thick with edges around each of its four sides 103 (see FIG. 12) that are approximately 0.115" thick each and extending 0.725" high from the flat surface. Any other suitable dimensions may be used.

The bottom piece 102 of the box is preferably 6.25" wide×6.25" long×2.01" high. Any other suitable dimensions may be used.

FIG. 10 is a side perspective view of a preferred embodiment of a storage box of the present invention with the top, game bold holder, game board, and directions removed, showing the game pieces.

A unique feature of the box 100 is a nook 105 within the bottom section of the box. Inside the nook are the five compartments 106, 107, 108, 109, and 110, designed to securely hold and easily remove the game pieces. The nook 105 may measure 3.875" wide×5.25" long×1.225" high and can begin 0.125" above the bottom of the box. Any other suitable dimensions may be used.

There are preferably five (5) compartments 106, 107, 108, 109, and 110 inside the nook. Each section is specifically designed to hold a particular set of pieces for the game:

1. ten neutral game pieces 111 measuring, for example 1.005" wide×3.8" long
2. seven X's 112 measuring, for example 1.06" wide× 2.675" long
3. seven O's 113 measuring, for example 1.06" wide× 2.675" long
4. separate compartments 107, 108 for each of the two dice 114 measuring, for example 0.83" wide×0.83" long.

Any other suitable dimensions may be used.

The compartments 109, 106, 110 holding the X,'s, O's and neutrals begin 0.125" from the bottom of the box and are 0.625" high. The compartments 107, 108, holding the die begin 0.27" from the bottom of the box and are 0.48" high. The rest of the nook 105 is open and ends 0.75" below the top of the bottom section of the box. Any other suitable dimensions may be used.

The upper portion 104 of the bottom section of the box fills out most of the remaining interior area of the box and measures 5.75" wide×5.75" long×0.75" deep from the top of the box. The perimeter of the upper area is recessed 0.125" on all four sides to allow for the top of the box to fit snuggly over the bottom. The recessed area may be 0.125" thick and 0.70" high. Any other suitable dimensions may be used.

Figure 13:
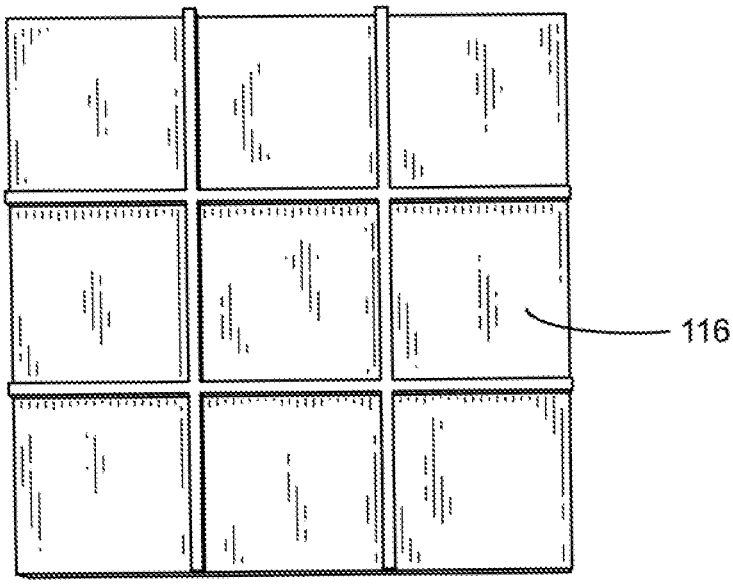
FIG. 13 is a top perspective view of a preferred embodiment of a game board of the present invention.
Figure 14:
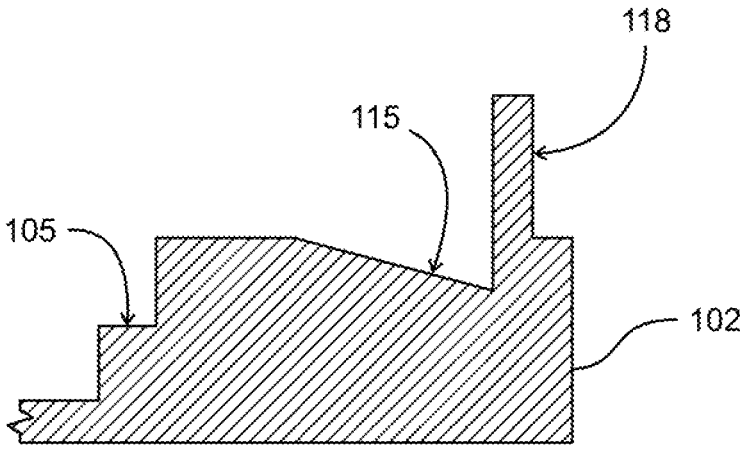
FIG. 14 is a sectional view taken along lines A to A of FIG. 10.

An additional special feature of the box bottom 102 is the "E-Z D Depression", a wedged-shape cutout 115 of the interior (see FIGS. 10 and 14). In an embodiment, this cutout 115 can measure, for example, 0.75" wide from one of the interior edges with a maximum depth of 1.0". This depression 115 allows users to easily remove the game board 116 and game board holder 117 (see FIGS. 12, 13), as discussed under Game Board Holder. Preferably, there is a marking 118 on the side of the box where the E-Z D Depression exists. As seen in FIG. 10, there are two holes 118 in the top edge of the box on the side. The marking 118 permits easy identification of the side with the depression 115 so the contents can be easily removed as described below. The E-Z Depression may be modified to another shape instead of a wedge, allowing the game board holder to be removed. The two holes 118 on one side of the box may be modified to another identifying shape or other marking.

Figure 11:
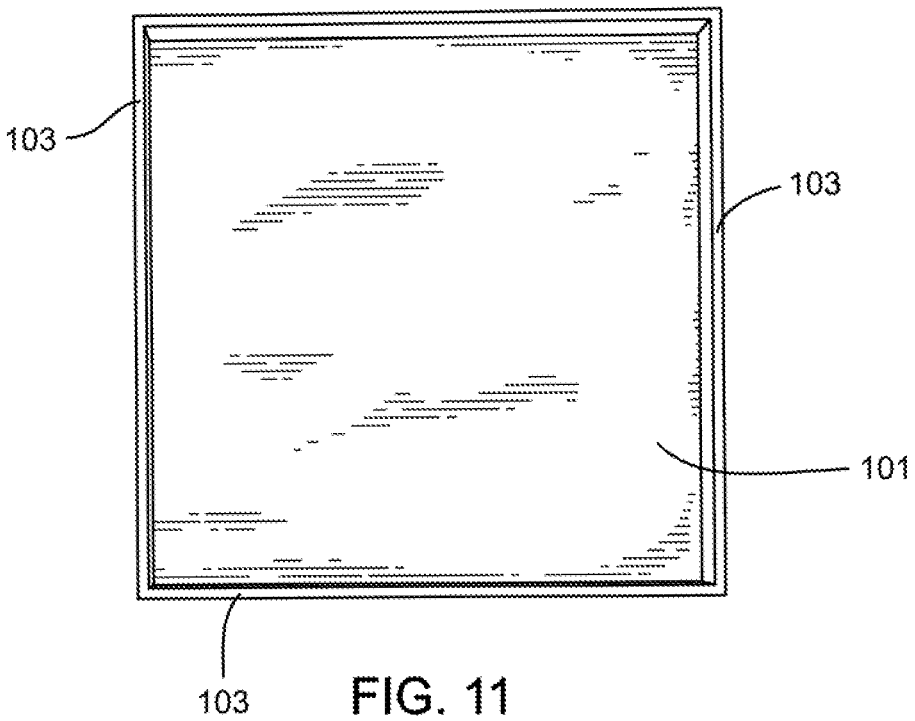
FIG. 11 is a top perspective view of a preferred embodiment of a storage box top of the present invention.

FIG. 11 is a top perspective view of a storage box top of a preferred embodiment of the present invention. Storage box top 101 can be placed upside down and the dice 114 rolled into the box top 101 to prevent them from falling on the floor when traveling. Storage top box 101 preferably has sides 103 which prevent the dice from exiting the storage top box 101. The user may choose to place a piece of felt into the bottom of the box top, which will allow the dice to roll more freely.

Figure 12:
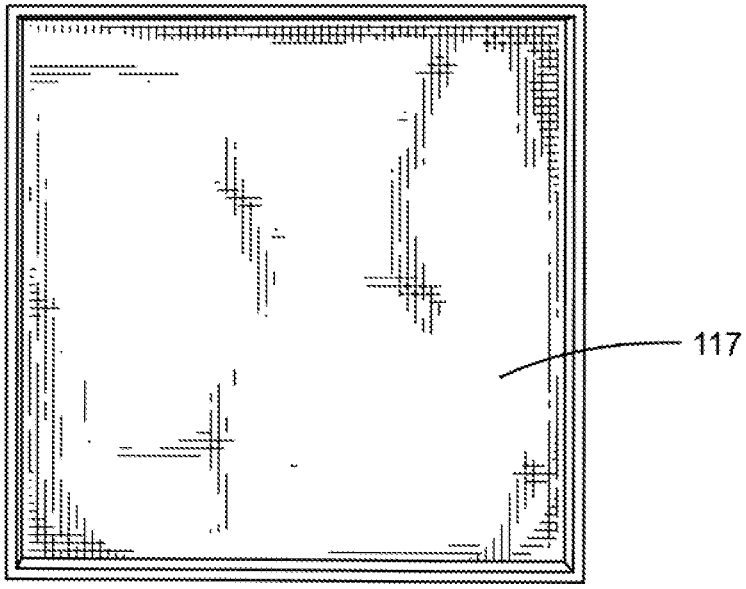
FIG. 12 is a top perspective view of a preferred embodiment of a game board holder of the present invention.

FIG. 12 shows a game board holder of a preferred embodiment of the present invention, designated generally by the numeral 117. Game board holder 117 is designed for travelling. In the embodiment photographed, the game board holder measures 5.7" wide×5.7" long×0.55" high and is included with the game. Any other suitable dimensions may be used. The purpose of the holder is to keep the game's pieces securely on the board if players wish to play the game while traveling, such as while riding in a moving vehicle, flying on a plane, or sailing on a ship.

The game board holder 117 has a base measuring 0.125" thick with a perimeter around the four edges, each 0.08" thick and extending 0.425" above the base, giving the game board holder a total height of 0.55". Any other suitable dimensions may be used. The game board holder fits into the box bottom with the base lying flat on the upper portion of the bottom of the box, and the game board fits on top.

FIG. 13 shows a game board of a preferred embodiment of the present invention, designated generally by the numeral 116. Game board 116 which is shown measures 5.5" wide×5.5" long. It has a flat base measuring 0.25" thick. It has four structures attached to the top of the base, two along the length and two along the width. Each of the four structures are 5.5" long×0.125" thick×0.25" tall, giving the game board its total ½" height. Any other suitable dimensions may be used. Two of the four structures are place at one-third points along the width and two at one-third points along the length, giving the game board its common Tic-Tac-Toe shape.

In various embodiments, the game board 116 and game board holder 117 are moved to access the playing pieces 111, 112, and 113, and dice 114. To remove the game pieces 111, 112, 113, 114 with ease, a player can gently push the down on the game board holder 117 by placing their thumb directly behind the two holes 118 in the side of the box bottom 102. This causes the game board and game board holder 117 to pivot, allowing easy access to the game's pieces 111, 112, 113, 114. Players can turn the game board holder 117 over to take the game board 116 out. Once the game board holder 117, game board 116, and instructions are removed, the pieces 111, 112, 113, 114 can be accessed as seen in FIG. 10. Throughout this application, reference is made to X pieces, O pieces, and N pieces or neutral pieces. However, such references are not intended to improperly limit the scope of the present invention. In various embodiments, the pieces can be referred to in any number of ways, as long as one is able to distinguish between the various types of pieces in the various embodiments. For example, X pieces may be referred to as a first set of pieces or by any other letter; O pieces may be referred to as a second set of pieces or by any other letter other than that chosen for the first set of pieces, and N pieces, or neutral pieces, may be referred to as a third set of pieces or by any other letter not utilized by the first two sets of pieces.

PARTS LIST

The following is a list of parts and materials suitable for use in the present invention:

PARTS NUMBER DESCRIPTION

10 sample record sheet of a preferred embodiment of the present invention
11 game board of a preferred embodiment of the present invention
12 "X" game pieces of a preferred embodiment of the present invention
13 "O" game pieces of a preferred embodiment of the present invention
14 "neutral" game pieces of a preferred embodiment of the present invention
15 game piece holder
16 sample record sheet of one embodiment of the present invention
17 dice
18 alternative "neutral" game pieces of the present invention
19 record sheet key
20 storage box
100 storage box
101 storage box top
102 storage box bottom
103 side
104 upper portion
105 nook
106 compartment
107 compartment
108 compartment
109 compartment
110 compartment
111 neutral pieces
112 "X" game pieces
113 "O" game pieces
114 dice
115 cutout/depression
116 game board
117 game board holder
118 marking/two holes
121 sample game board All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A board game comprising a game board, "X" game pieces, "O" game pieces, "neutral" game pieces, two six-sided dice, a record sheet, and a game piece storage container, wherein:

(a) the game board is a square evenly divided into nine smaller squares;

(b) the neutral pieces are two-sided, having an "X" on one side and an "O" on the other side;

(c) the record sheet is utilized to record "X Moves", record "Y Moves", and to note which turn the move corresponds to; and (d) the storage container comprises a top piece and a bottom piece, the bottom piece further comprising an inner nook, said nook comprising multiple compartments for holding game pieces, and a depression, wherein the depression is adjacent to a side of the bottom of the container, wherein the depression has a shallow end and a deeper end and is angled so that the deeper end is adjacent to the side of the container and the shallow end is closer to the center of the container than the deeper end.

2. The board game of claim 1, wherein each die comprises three sides designated with a neutral designation.

3. The board game of claim 1, wherein at least one of the game board and pieces are metal and at least one of the game board and pieces comprise magnets.

4. The board game of claim 1, further comprising a score sheet.

5. The board game of claim 1, wherein there are 7 "X" game pieces, 7 "O" game pieces, and 10 neutral game pieces.

6. The board game of claim 1, comprising at least 2 dice, wherein each of the dice includes at least one side designated with a neutral designation.

7. The board game of claim 1, wherein the storage container has 5 compartments.

8. The board game of claim 1, wherein each die has a neutral designation on three sides.

9. The board game of claim 8, wherein one die has an "X" designation on three sides and the other die has an "O" designation on three sides.

* * * * *